United States Patent [19]

Flisram

[11] Patent Number: 5,065,656

[45] Date of Patent: Nov. 19, 1991

[54] FOOD SLICING WITH MULTIPLE CUTTING SURFACE BLADE

[75] Inventor: Dennis G. Flisram, Plainfield, Wis.

[73] Assignee: Oscar Mayer Foods Corporation, Madison, Wis.

[21] Appl. No.: 586,066

[22] Filed: Sep. 21, 1990

[51] Int. Cl.[5] ..... B26D 1/28

[52] U.S. Cl. ..... 83/356.003; 83/42; 83/596; 83/665; 83/675; 241/292.001

[58] Field of Search ..... 83/35, 42, 48, 56, 72, 83/356, 356.3, 591, 595, 596, 663, 666, 672, 675, 676, 665; 241/292.1

[56] References Cited

U.S. PATENT DOCUMENTS

| | | | |
|---|---|---|---|
| 1,401,978 | 1/1922 | Hall | 241/292.1 |
| 2,966,186 | 12/1960 | Garapolo . | |
| 3,299,925 | 1/1967 | McBrady et al. | 83/675 |
| 3,631,907 | 1/1972 | Laska | 241/292.1 |
| 3,762,257 | 10/1973 | Mathews, Jr. . | |
| 3,897,020 | 7/1975 | Knecht | 83/675 |
| 4,523,501 | 7/1985 | Mengel | 83/42 |
| 4,638,697 | 1/1987 | Hagel et al. | 83/595 |
| 4,966,332 | 10/1990 | Laska | 241/292.1 |

*Primary Examiner*—Mark Rosenbaum
*Assistant Examiner*—Scott A. Smith
*Attorney, Agent, or Firm*—Lockwood, Alex, Fitzgibbon & Cummings

[57] ABSTRACT

An apparatus is provided for slicing food product sticks such as loaves or chubs or the like of meat and cheese. A blade assembly is utilized which includes a plurality of, typically two, blade members, each of which has a curved cutting surface that terminates at a trailing tip. A non-slicing mode is achieved by having the blade assembly exhibit a substantial gap between the trailing tip of one blade member and the curved cutting surface leading edge of another blade member. The apparatus is particularly well suited for enhancing the throughput of a food processing line and for improving the quality of sliced products processed therethrough.

3 Claims, 1 Drawing Sheet

FOOD SLICING WITH MULTIPLE CUTTING SURFACE BLADE

BACKGROUND AND DESCRIPTION OF THE INVENTION

The present invention generally relates to the slicing of food products utilizing a blade having multiple cutting surfaces. More particularly, the invention relates to a particular multiple cutting surface blade and to its use in a procedure which allows industrial-sized sticks of meat and the like to be sliced at high throughput rates without having to utilize high rotational speeds of the cutter blade. The invention is especially well-suited for slicing lean whole muscle meat products which cannot be frozen.

Proteinaceous materials such as luncheon meats, whole muscle meats, cheeses and the like for many years have been processed on an industrial scale whereby large sticks, loaves, chubs and the like are fully processed and packaged at a food processing plant. Typically, a large stick, weighing many pounds, is formed and/or handled in food processing machinery. Machinery of this type, in many applications, includes slicing machines for severing these multi-pound sticks into slices which are then stacked and packaged in order to provide any of a variety of different packaged slice food products which are sold commercially in large quantities.

As with most commercial production operations, an important consideration for cost-effectiveness is to maximize the quantity of finished products which are produced for each processing line. In many food processing lines, slicing can be an operation which determines to a large extent the throughput or poundage of product which is processed by the line. Consequently, at times the throughput of a food processing and packaging line can be determined to a large extent by the speed at which the slicing apparatus performs its function. The typical commercial food processing slicing apparatus is one which incorporates a blade that operates in a rotary manner; consequently, when increased line throughput is desired, one of the adjustments that typically is attempted is to increase the rotational speed or revolutions per minute of the slicing blade present on the food processing line.

Increasing of blade speed cannot be accomplished in an unlimited manner. Properties of the food stick being sliced limit acceptable cutting speeds. Cutting speed limits, of course, vary from food product to food product. For example, with respect to meat sticks, those which are particularly consistent and uniform throughout the stick, such as those that are formed by an emulsion type of process wherein there are no readily discernible domains of lean, fat, meat, muscle, filler, or the like, are more compatible with being sliced at relatively high speeds under customary commercial processing conditions than are other types of food products. Those relatively high speeds typically are not attainable by other meat products which are of the so-called whole muscle variety wherein domains of lean, fat, muscle and the like are readily discernible. One such product is known as whole muscle ham. When products of this latter type are subjected to slicing at the food processing plant, the upper limit of cutting speed, such as revolutions per minute of a rotary blade, is relatively low because of the tendency of these types of products to tear or develop holes or ragged edges or other deformities which are not acceptable for most industrially processed and packaged food products.

It has been proposed, and attempts have been made, to increase the slicing speed upper limit or threshold by lowering the temperature of the stick or the like to be sliced to such an extent that the stick itself either is substantially fully frozen or is subjected to what is known as crust freezing wherein at least the outer portions of the stick or the like are frozen. By this latter approach, it is suggested that the crust freezing holds the edges of the product together more effectively than when the stick or the like is otherwise at typical industrial slicing temperatures, which tend to be in the vicinity of, but above, the temperature at which the stick will be crust frozen. One of the disadvantages of using the freezing or crust freezing approach is that the finished, packaged product might not be as acceptable as a packaged product which has not been subjected to freezing. For example, when frozen or crust frozen slices thaw, moisture tends to be drawn out of the product. If this moisture drawing continues after packaging or even if the slices are merely too moist when packaged, so-called purging occurs within the package, and the packaged product will exhibit undesirable properties including the appearance of fluids within the sealed package.

Accordingly, there is a need for an arrangement whereby industrial scale sticks or the like of food product, particularly meat sticks, can be handled in a manner which increases throughput of a given line through means other than increasing the rotational speed of the slicer blade. It is also desirable that this procedure also improve product quality such as by having the slicing blade run at speeds which will not damage the stick or slices and which is accomplished without resorting to other manipulations, such as crust freezing procedures and the like.

In summary, the present invention avoids the need to increase blade speed of a rotary cutting blade by providing a blade having multiple cutting surfaces which are spaced from each other. This feature is combined with feeding of the stick of food product during blade rotation and into the space between the cutting surfaces, with the result that, for each revolution of the rotary blade assembly, a number of slices are prepared which correspond to the number of spaced blade surfaces present on the blade assembly. For example, when two generally radially spaced cutting surfaces are included on the blade assembly, two slices will be cut from the stick during each revolution of the blade assembly.

It is accordingly a general object of the present invention to provide an improved slicing apparatus and method for increasing throughput while maintaining or enhancing slice quality.

Another object of this invention is to provide an improved slicing apparatus and method which are particularly suitable for slicing whole muscle meat products at enhanced throughput speeds.

These and other objects, features and advantages of the present invention will be clearly understood through a consideration of the following detailed description.

BRIEF DESCRIPTION OF THE DRAWINGS

In the course of this description, reference will be made to the attached drawings, wherein.

DESCRIPTION OF THE PARTICULAR EMBODIMENTS

Figure 1:
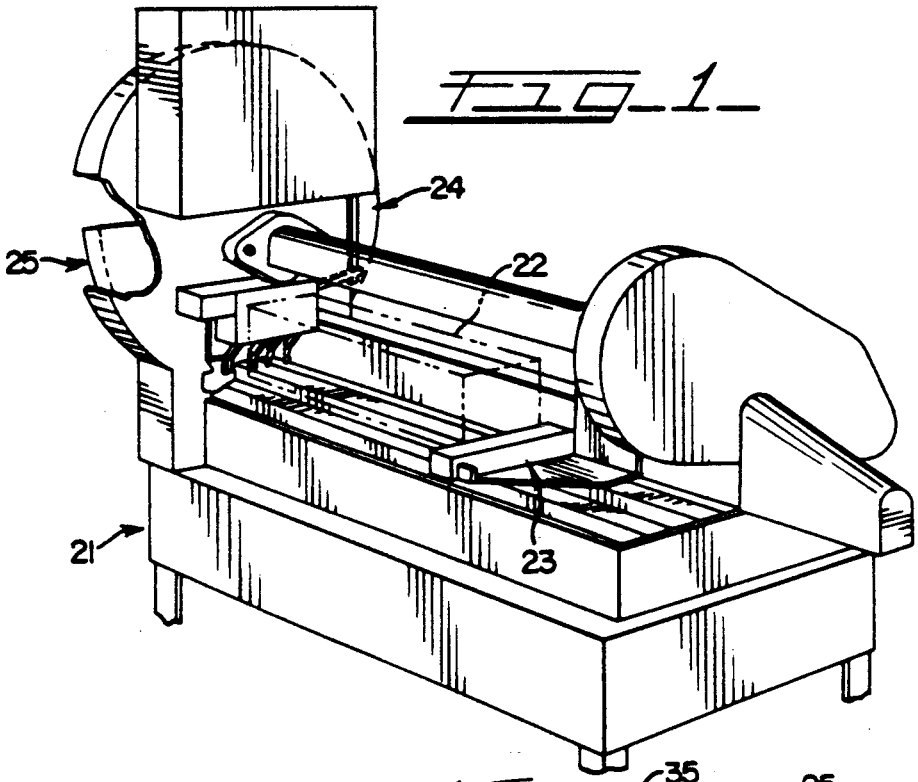
FIG. 1 is a perspective view illustrating a typical slicing apparatus in accordance with the present invention.

A slicing apparatus, generally designated as 21, of a typical construction as used in the food industry is illustrated in FIG. 1. The illustrated slicing apparatus 21 is one in which an industrial-sized food item, such as the illustrated meat stick 22, is delivered by a feed assembly, generally designated as 23, into a slicing assembly, generally designated as 24. Devices of this general type are well-known in the art and are available from various manufacturers of commercial slicing equipment. While a horizontal feed arrangement is shown in FIG. 1, devices having vertical feeds, slanted feeds or the like are also well known, and these also can incorporate the present invention.

Slicing apparatus 21 includes a blade assembly, generally designated as 25. Blade assembly 25 includes two blade members 26 and 27. Additional blade members (not shown) could be included in order to provide the desired number of multiple cutting surfaces. Each blade member 26, 27 has a cutting surface 28, 29, respectively. Each cutting surface, 28, 29 and typically the blade member 26, 27 of which it is an integral component, or to which it is removably secured, provides a curved, involute surface which is designed to afford proper cutting of the stick 22 as the blade assembly 25 passes through and slices the stick 22. The illustrated involute curve is a combination of two arcuate surfaces. One is a leading edge arcuate surface 31, 32, which has a radius smaller than a trailing edge arcuate surface 33, 34, the respective leading edge and trailing edge arcuate surfaces joining with one another in a manner well-known in the art. In the illustrated blade assembly 25, each cutting surface 28, 29 is detachably affixed to each blade member 26, 27 by suitable fastening members 35, such as bolts, rivets or the like.

Figure 2:
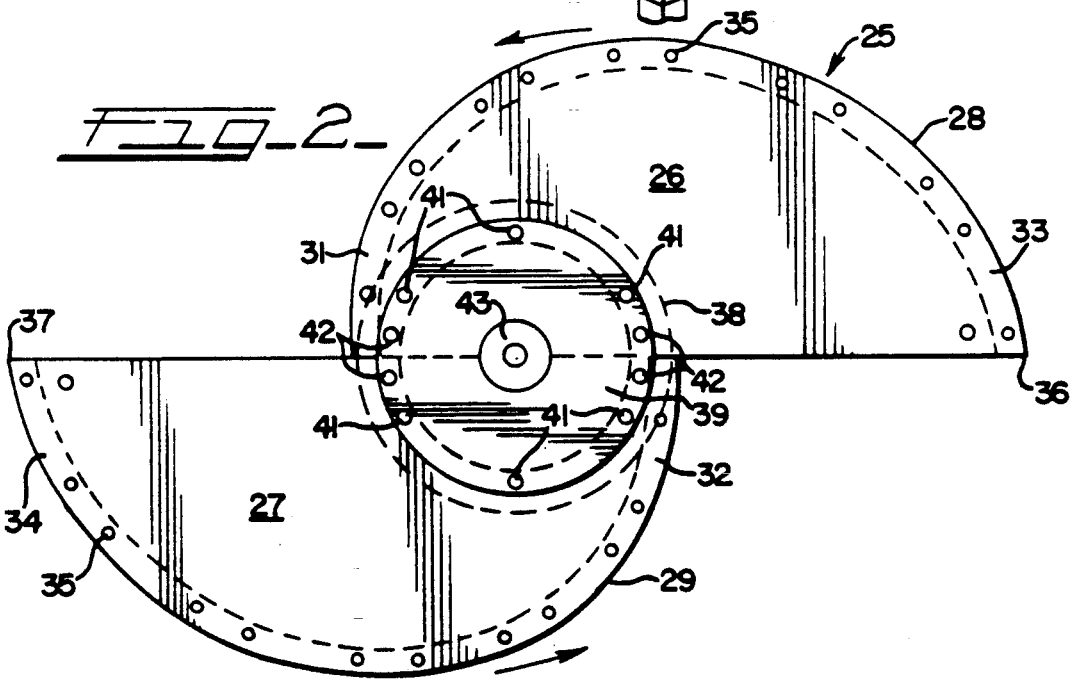
FIG. 2 is a plan view of a blade assembly in accordance with the present invention, shown with two cutting surfaces.

The illustrated blade assembly 25 is constructed by joining the blade members 26, 27 in a manner whereby the two cutting surfaces are staggered from each other so the device will provide, during any one revolution of the blade assembly 25, two cutting modes spaced from each other by two non-cutting modes. In the illustrated embodiment, this is accomplished by widely separating each trailing tip 37, 36 from each leading edge arcuate surface 32, 31 by a substantial generally radially extending distance. Accordingly, the cutting mode of the first blade begins when the leading portion of the leading edge arcuate surface 31 engages the stick 22, and this mode continues until the trailing tip 36 leaves the stick 22, the blade assembly 25 moving in a counterclockwise direction as illustrated in FIG. 2. The first non-slicing mode then occurs until the leading portion of the leading edge arcuate surface 32 first engages the stick 22. During this non-slicing mode time period, the stick 22 is still being fed by the feed assembly 23 in a direction toward and into the blade assembly 25, with the result that the stick 22 has been further advanced, and the timing thereof is arranged such that the desired slice thickness is achieved by virtue of this feeding of the stick 22. The second cutting mode, which is thus begun with the time of initial cutting engagement between the leading edge arcuate surface 32, continues through to the emergence of the trailing tip 37 out of the stick 22. The second non-cutting mode then begins and continues until the stick is again engaged by the leading edge arcuate surface 31.

Figure 3:
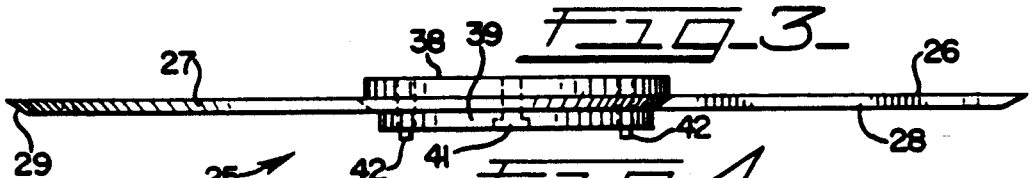
FIG. 3 is a plan view of the blade assembly shown in FIG. 2.
Figure 4:
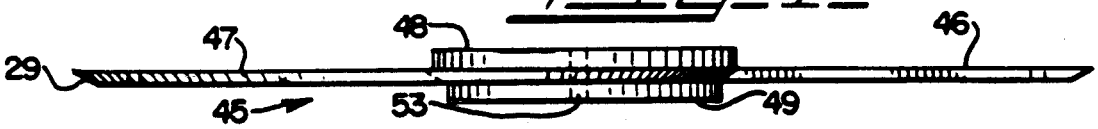
FIG. 4 is a plan view of another embodiment of the blade assembly.

Blade members 26 and 27 of the illustrated embodiment are joined together by being sandwiched between a pair of plates 38 and 39. Securement together of the illustrated blade assembly 25 is achieved by a plurality of countersunk bolts 41 or the like in combination with a plurality of dowel pins 42, which press fit into suitable bores within the assembly in order to maintain true alignment of the blade members 26, 27. A mounting recess and hole 43 is also provided. It will be appreciated that, although blade assembly 25 that is illustrated in FIGS. 2 and 3 is composed of four major separate pieces which are joined together, other manufacturing and/or assembly approaches can be utilized. For example, FIG. 4 illustrates a blade assembly 45 which is a single-piece unit including blade members 46 and 47 and raised plate surfaces 48 and 49. A mounting hole 53 passes through the blade assembly 45.

It will be appreciated that, for each revolution of the illustrated blade assembly 25 through the stick 22 while it is being fed will result in the formation of two slices of food such as luncheon meat or the like. Accordingly, the throughput of a food processing line incorporating the invention will be substantially doubled at the slicing apparatus when compared with a conventional, single cutting surface blade assembly which is operating at the same rotational speed. This means that, even without increasing the speed at which each cutting surface passes through the stick or the like, the throughput is generally doubled when compared with the throughput provided by a conventional blade.

Being able to refrain from increasing rotational speed avoids damage to or misshaping of the stick or slice which would be caused by a blade moving therethrough at a substantially greater speed, such as approximately twice the rotational speed. This means that clean and even cutting can be accomplished without requiring any modification of the stick itself, such as totally freezing or crust freezing the surface of the stick and the like, which is particularly important for products subject to freezing damage, such as lean whole muscle types of meat products.

It will thus be seen that the present invention provides new and useful cutting arrangements having advantageous properties and characteristics, including those pointed out herein and others which are inherent in the invention. Preferred embodiments of the invention have been described by way of example, and it is anticipated that modifications may be made to those described herein without departing from the spirit of the invention or the scope of the appended claims.

I claim:

1. An apparatus for providing a series of sliced food products from a large stick of meat or other food product, comprising:

means for supporting and feeding a food stick to and into a slicing assembly having a rotary mounted blade assembly which rotates into generally perpendicular severing and slicing engagement with and completely through an end of the food stick;

said blade assembly including a substantially centrally positioned mounting member and first and second blade member, each said blade member having a curved cutting surface having a length adequate to cut completely through a perpendicular cross-section through the food stick, said curved cutting surface includes a leading edge of each curved cutting surface and terminates at a trailing tip of the blade member curved cutting surface, each said blade member lying generally along a same plane, each blade member having a straight edge extending between said leading edge and said trailing tip, wherein a portion of the straight edge of said first blade member is adjacent to a portion of the straight edge of said second member such that the interface between said straight edge portions lies substantially coincident with a line between said trailing tips; and each said leading edge of the curved cutting surface is spaced from said mounting member by a radial distance that is substantially less than the radial distance by which each said trailing tip is spaced from said mounting member, such that the leading edge of the curved cutting surface of one of said blade members is radially offset from the trailing tip of another of said blade members thereby defining a gap of said blade assembly which imparts a non-slicing mode to the apparatus when said blade assembly is rotating and when said supporting and feeding means is feeding the food stick to and into said slicing assembly, at least two of said gaps being provided, whereby the apparatus has alternating slicing modes and non-slicing modes, each said slicing mode beginning when the curved cutting surface of one of said blade members is in generally perpendicular severing and slicing engagement with the food stick and ending when a slice is completely severed from the food stick, and each said non-slicing mode being when the food stick is within one of said gaps and out of engagement with the rotating blade assembly, and whereby at least two slices of the food stock are severed from the food stock during each rotation of said blade assembly through the end of the food stick.

2. The apparatus according to claim 1, wherein each said curved cutting surface of each blade member has an involute configuration.

3. The apparatus according to claim 1, wherein said mounting means includes a pair of opposing plates, one on each side of the blade members.

* * * * *

UNITED STATES PATENT AND TRADEMARK OFFICE

CERTIFICATE OF CORRECTION

PATENT NO. : 5,065,656

DATED : November 19, 1991

INVENTOR(S) : Dennis G. Flisram

It is certified that error appears in the above-identified patent and that said Letters Patent is hereby corrected as shown below:

Col. 6, lines 16 and 17, "stock" should read --stick--.

Signed and Sealed this

Twenty-fourth Day of August, 1993

*Attest:*

*Attesting Officer*

BRUCE LEHMAN

*Commissioner of Patents and Trademarks*